US005577921A

United States Patent [19]

Philyaw et al.

[11] Patent Number: 5,577,921

[45] Date of Patent: Nov. 26, 1996

[54] ELECTRICAL CONNECTOR SYSTEM FOR ELECTRICALLY CONNECTING A VOLTAGE SOURCE TO A SPARK PLUG TERMINAL

[75] Inventors: Dale A. Philyaw, West Point; W. Peter Siems, W. Lafayette, both of Ind.

[73] Assignee: Caterpillar Inc., Peoria, Ill.

[21] Appl. No.: 491,207

[22] Filed: Jun. 16, 1995

[51] Int. Cl.[6] ..... H01R 11/11

[52] U.S. Cl. ..... 439/125; 123/169 PA; 123/635

[58] Field of Search ..... 439/125, 126, 439/127, 128; 123/635, 169 PA

[56] References Cited

U.S. PATENT DOCUMENTS

| | | | |
|---|---|---|---|
| 5,026,294 | 6/1991 | Hisatomi et al. | 439/125 |
| 5,038,745 | 8/1991 | Krappel et al. | 123/635 |
| 5,060,624 | 10/1991 | Bruning et al. | 123/635 |
| 5,332,394 | 7/1994 | Frost | 439/125 |
| 5,406,242 | 4/1995 | Klocinski et al. | 439/125 |

*Primary Examiner*—P. Austin Bradley
*Assistant Examiner*—T. C. Patel
*Attorney, Agent, or Firm*—Kenneth A. Rhoads

[57] ABSTRACT

A transformer assembly having an elongate body including a cup portion containing primary and secondary coils, a base portion, and a stem is adapted to be installed in a housing of a cylinder head. An electrical source extends through the stem and base portion. An electrical connecting system includes an electrical conductor adapted to receive the voltage source with a spring contacting the end of a spark plug terminal biasing the conductor in a director away from the spark plug in the installed position. The electrical connector system further includes a positioning device adapted to positive align and contain the transformer assembly within a valve mechanism compartment defined between a cover and the cylinder head. A spring member connected to the cup portion axially biases the electrical conductor in a direction toward the spring in contact with the spark plug terminal insuring an electrical connection.

1 Claim, 5 Drawing Sheets

210
204
198
206
216
210
200
204
A
202
204
206
204
208
208
94
30
92
10
98
96
116
136

ELECTRICAL CONNECTOR SYSTEM FOR ELECTRICALLY CONNECTING A VOLTAGE SOURCE TO A SPARK PLUG TERMINAL

TECHNICAL FIELD

This invention relates generally to an electrical connection system for an internal combustion engine, and more particularly to an electrical connection system for connecting a voltage source to a terminal of a sparkplug and the positioning thereof within a valve mechanism compartment.

BACKGROUND ART

U.S. Pat. No. 5,060,634 issued on Oct. 29, 1991 to Bruning et al. is one example of an ignition system for a heavy duty spark ignited internal combustion engine. The ignition system includes an ignition transformer assembly releasable connected to a terminal portion of a spark plug of such engine within a valve mechanism compartment. A spring member having a plurality of deflectable legs properly orient the ignition transformer within the valve mechanism compartment.

The design of U.S. Pat. No. 5,060,624 employs the traditional contact means or spring clips to establish electrical contact between the electrical source and the terminal portion of the spark plug. The arrangement does not accommodate for any variation in the axial length of the transformer assembly and spring clip due to manufacturing tolerances "stack-up" between the various parts within the valve cover. If the axial length is too long the contact means is forced against the terminal end of the spark plug which could result in cracking of the spark plug porcelain. If the axial length is too short a gap could result between the contact means and the terminal portion of the spark plug which would impede electrical conduction.

On spark ignited, internal combustion engines there are several types of connectors used to for making the electrical connection from the voltage source to the terminal portion of the spark plug. For many applications the existing art solves the problem. However, for many heavy duty engines the problem remains unsolved. Typically, the voltage source is connected to the terminal portion of the spark plug by a conductive spring clip connector that fits over the terminal portion. The spring clip connector typically has dimples that grip a groove of the terminal portion thereby mechanically securing the connector to the terminal portion for making electrical connection from the voltage source to the spark plug. While inexpensive to manufacture, the clamping force diminishes over time as metal relaxes and deforms due to vibration and high heat resulting in far less than optimum electrical conduit. This is exacerbated by the fact that many large stationary engines often run continuously. The gripping force is also effected by manufacturing tolerances of the spark plug terminal portion and the spring clip. The consequences of ignition failure are great, resulting in costly engine downtime and a lost production.

U.S. Pat. No. 5,322,394 issued Jul. 26, 1994 to E. L. Frost is one example of a spring clip connector that grips the terminal portion of the spark plug. This example also includes a spring which applies an axial spring force on the terminal end of the terminal portion for improved electrical. However, such axial force would tend to push the spring clip off of the terminal if not opposed.

The electrical connector system of the present invention eliminates the traditional spring clip. The electrical connector is so constructed and arranged that electrical contact is provided exclusively through a volute spring contacting the end of the terminal. A second spring axially biases the electrical conductor in a direction toward the volute spring to accommodate a variation is axial length due to tolerance between elements preventing damage of the components and insuring an electrical connection with the terminal portion of the spark plug.

DISCLOSURE OF THE INVENTION

In one aspect of the invention, an electrical connector system for electrically connecting a voltage source to a spark plug having a terminal end and a terminal portion. The electrical connector system includes an electrical conductor having first and second end portions, an axis, an opening extending into the second end portion. The first end portion is adapted to receive a voltage source and the second end portion opening is of a relative size sufficient that the conductor is free from all contact with the spark plug terminal portion in the installed position of the spark plug. A spring positioned within the conductor second end portion is in electrical conducting contact with the conductor and the spark plug terminal end. The spring biases the electrical conductor in a direction away from the spark plug in the installed position.

The electrical connector system further includes positioning means for axially biasing the electrical conductor in a direction toward the spring and the spark plug terminal end.

In another aspect of the invention, an electrical connector system for electrically connecting a voltage source to a spark plug having a terminal end and a terminal portion. The spark plug terminal portions has an axis and sidewalls. The electrical connecting system includes an electrical conductor having first and second end portion, an axis, and an opening extending into the second end portion. The opening has opening sidewalls. The first end portion is adapted to receive a voltage source and the second end portion is adapted to receive the spark plug terminal therein. The second end portion opening is of a relative size sufficient that the opening sidewalls are free from contact with the spark plug terminal portion. The spark plug terminal portion is shielded by the electrical conductor second end portion and free from all contact in the installed position of the spark plug in the electrical conductor. A spring positioned within the conductor second end portion, and in electrical conducting contact with the conductor and the terminal end of the spark plug terminal, biases the electrical conductor in a direction away from the spark plug in the installed position. The electrical connector system further includes means for axially biasing the electrical conductor in a direction toward the spring and the spark plug end.

BEST MODE FOR CARRYING OUT THE INVENTION

Figure 1:
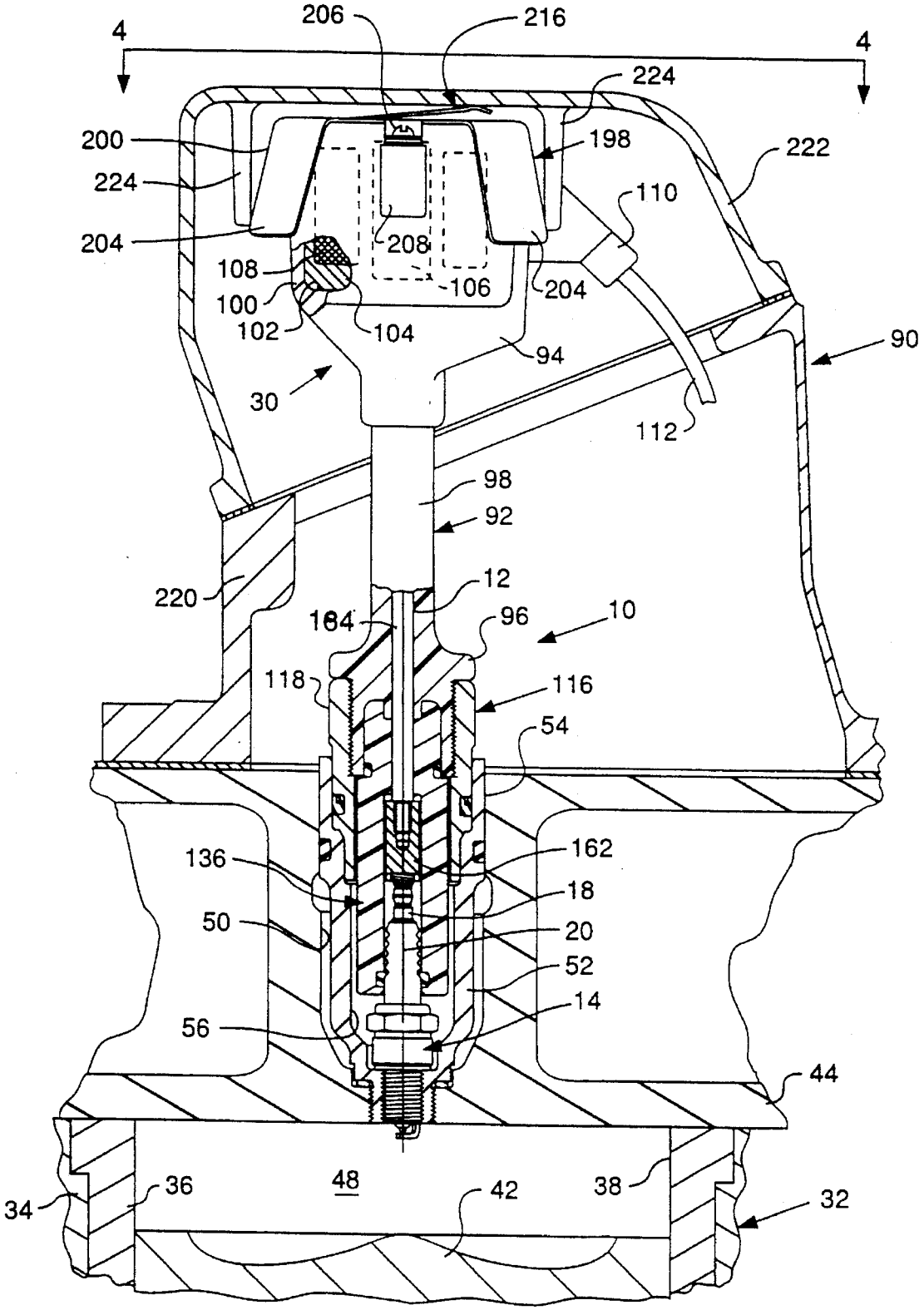
FIG. 1 is a diagrammatic elevational view of an electrical connector system constructed in accordance with the present invention, with certain portions of the system and the engine shown in cross section to better illustrate details thereof.

An electrical connector system 10 for electrically connecting a voltage source 12 to a spark plug 14 having a terminal end 16 and a terminal portion 18. The spark plug 14 terminal portion 18 has a central axis 20 and sidewalls 22. The electrical connector system 10 further includes a transformer assembly 30 as shown in FIG. 1 which is adapted for use with one cylinder of a multicylinder internal combustion engine 32. The engine 32 has a block 34, a plurality of cylinder liners 36 in the block, one of which is shown, and with each one of the liners defining a bore 38. A piston 42 is reciprocally disposed in each of the bores 38 and a cylinder head 44 is releasably connected to the block 34 so that a combustion chamber 48 is defined between the liner 36, the piston, and the cylinder head at each piston as is the conventional case. The cylinder head 44 has a profiled head bore 50 therethrough concentrically arranged along the central axis 20. As used herein, the terms downwardly, upwardly, top, lower and alike should be considered relative to viewing FIG. 1 and the central axis 20 thereof since on a V-shaped engine the piston bores 38 would clearly be angularly inclined with respect with the vertical axis.

Figure 2:
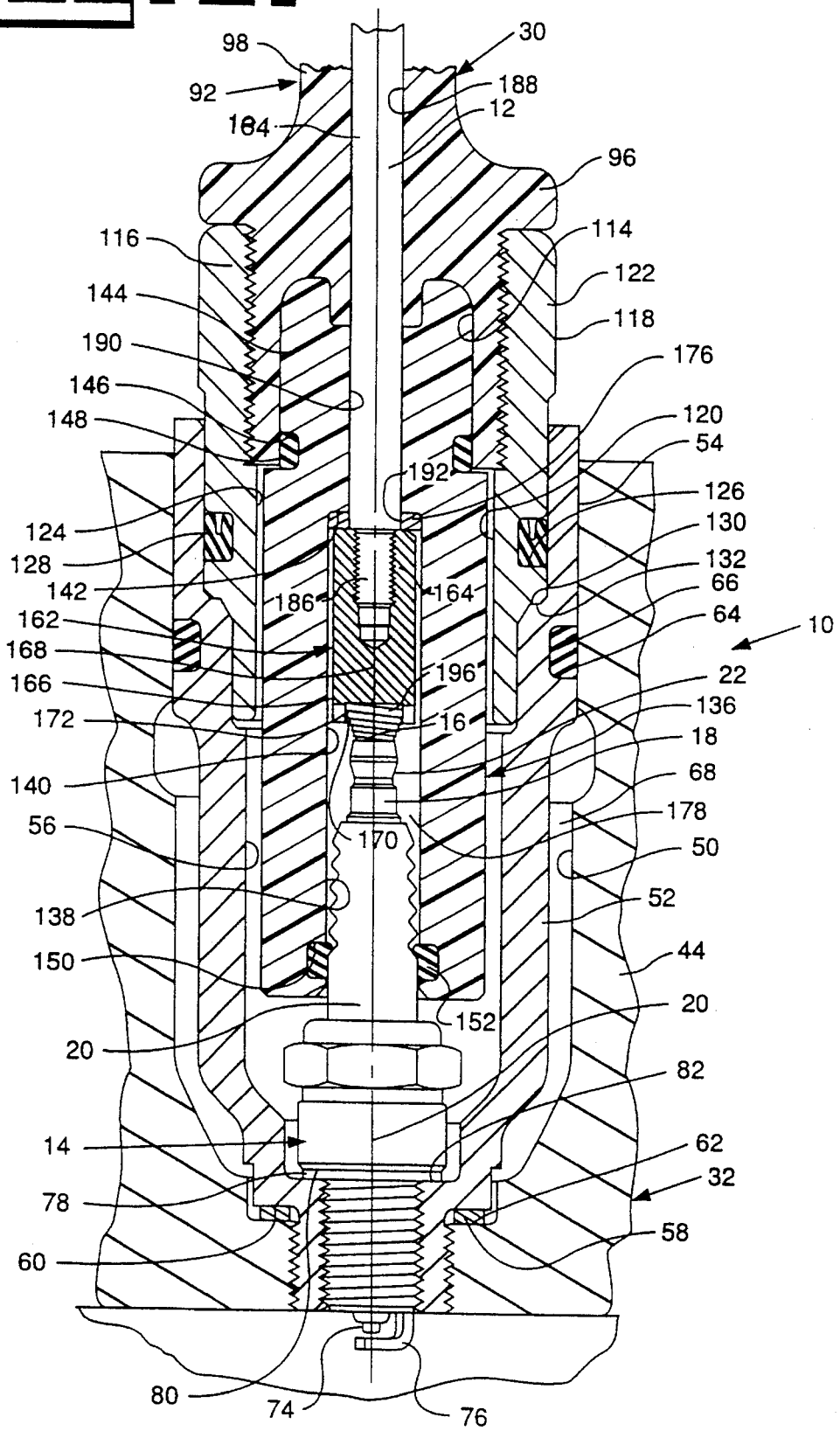
FIG. 2 is an enlarged, diagrammatic view of a portion of the electrical connector system constructed in accordance with the present invention, with certain portions of the system and, engine shown in cross section to better illustrate details thereof.

As illustrated in FIG. 1 and in greater detain in FIG. 2, a cylindrical housing 52 is threadably secured to the cylinder head 44. The housing 52 has an outer profiled peripheral housing surface 54 and a profiled housing bore 56 therethrough concentrically arranged along the central axis 20. A sealing housing washer 58 is urged by a flange 60 on the housing 52 tightly against an annular seat 62 formed by the head bore 50 to prevent the flow of any gas or liquid. A resilient o-ring 64 is disposed in a annular housing groove 66 defined in the housing surface 54 sealing the space between the housing 52 and the head bore 50. The head bore 50 and the housing surface 54 defines a water filled chamber 68.

The spark plug 14 is threadably secured in the housing 52 so that an active or chargeable electrode 74 and a grounded electrode 76 extend downwardly into the combustion chamber 48. A spark plug sealing washer 78 is urged by a flange 80 on the spark plug 14 tightly against an annular housing seat 82 formed by the housing bore 56 to prevent the flow of gas by the spark plug in the usual way.

A cover apparatus 90 is releasably secured to the upper surface of the cylinder head 44 for sealingly containing a conventional valve operating mechanism, not shown.

As is shown in FIG. 1, the ignition transformer assembly 30 includes a unitized elongate body 92 constructed of a dielectric material and includes an upper cup portion 94, a lower base portion 96 and a stem portion 98 interconnecting the cup and base portion. The cup portion 94 has a generally cylindrical wall 100 and a bottom 102 defining an upwardly facing cavity 104 adapted to receive a coil 106 and a secondary coil 108 disposed about the primary coil in a conventional manner. An electrical coupling member 110 extends radially outwardly from the cup portion 94 and is adapted to receive a low tension cable 112. The cable 112 leads to a capacitive discharge or induction type ignition system or any conventional type, which is not illustrated herein since it forms no part of the present invention. The base portion 96 defines a downwardly facing counterbore 114.

As illustrated in FIGS. 1 and 2 a tubular adapter 116 is threadably connected to the lower base portion 96 of the transformer assembly 30. The adapter 116 has an outer peripheral profiled surface 118 and an adapter bore 120. The adapter bore 120 has an upper threaded portion 122 and lower inner peripheral surface 124. The tubular adapter 116 is threadably connected to the lower base portion 96 whereupon the adapter and the base portion are glued or otherwise permanently bonded at the threaded joint. The outer peripheral surface 118 of the adapter 116 telescopically mates with the housing bore 56 and is adapted for sliding relative movement. The outer peripheral surface 118 of the adapter 116 defines an annular groove 126 and an annular resilient adapter lip type seal ring 128 is disposed in the groove. The profiled bore 56 of the housing 52 also has an upwardly facing annular seat 130 and the adapter has a ledge 132. In the installed position the ledge 130 abuts the seat 130 and limits the downward movement of the transformer assembly 30.

Furthermore, the ignition transformer assembly 30 includes a generally tubular insulating shield 136 having a shield counterbore 138 therein defining an internal peripheral surface 140 and a downwardly facing annular shield seat 142. The shield 136 also has a reduced diameter upper cylindrical surface 144. A first annular groove 146 is defined in the cylindrical surface 144 and a first resilient o-ring seal 148 is disposed in the groove. The cylindrical surface 144 is disposed upwardly into a tight and sealing registry with the counterbore 114 of the base portion 96. A second annular groove 150 is defined in the lower portion of the counterbore 138 with a second resilient o-ring seal 152 disposed in the groove. The seal 152 grips the spark plug 14 in the assembled position.

As best illustrated in FIG. 2, a generally cylindrical electrical conductor 162 having first and second end portions 164, 166, and an axis 168 coaxial with the axis 20 of the terminal portion 18 is disposed in the shield counterbore 138. The conductor 162 has an opening 170 extending into the second end portion 166. The opening 170 has opening sidewalls 172. The first end portion 164 is adapted to receive the voltage source 12. A washer 176 is disposed between the first end portion 164 of the conductor 162 and the shield seat 142. The upper washer 176 and the second seal 152 delineate the opposite ends of an enclosed chamber 178 within the counterbore 138.

The voltage source 12 includes an electrically conducting metallic core or solid cylindrical element 184 having a threaded lower end 186. The element 184 is disposed within a corresponding passage 188 define in the base and stem portions 96 and 98 of the main body 92 of the transformer assembly 30, an axial shield passage 190 defined in the shield 136 and a washer passage 192 defined in and the washer 176. The element 184 is electrically connected to the secondary coil 108 internally within the cup portion 94 and with the opposite end threadably connected to the first end portion 164 of the conductor 162.

A volute spring 196 is positioned within the opening 170 of the conductor second end portion 166. The second end portion 166 is of sufficient size for housing the upper portion of the volute spring and does not extend over the spark plug terminal portion 18. The spring 196 is in electrical conducting contact with the conductor 162 and the terminal end 16 of the spark plug 14, and biases the electrical conductor 162 in a direction away from the spark plug 14 in the installed position.

Figure 3:
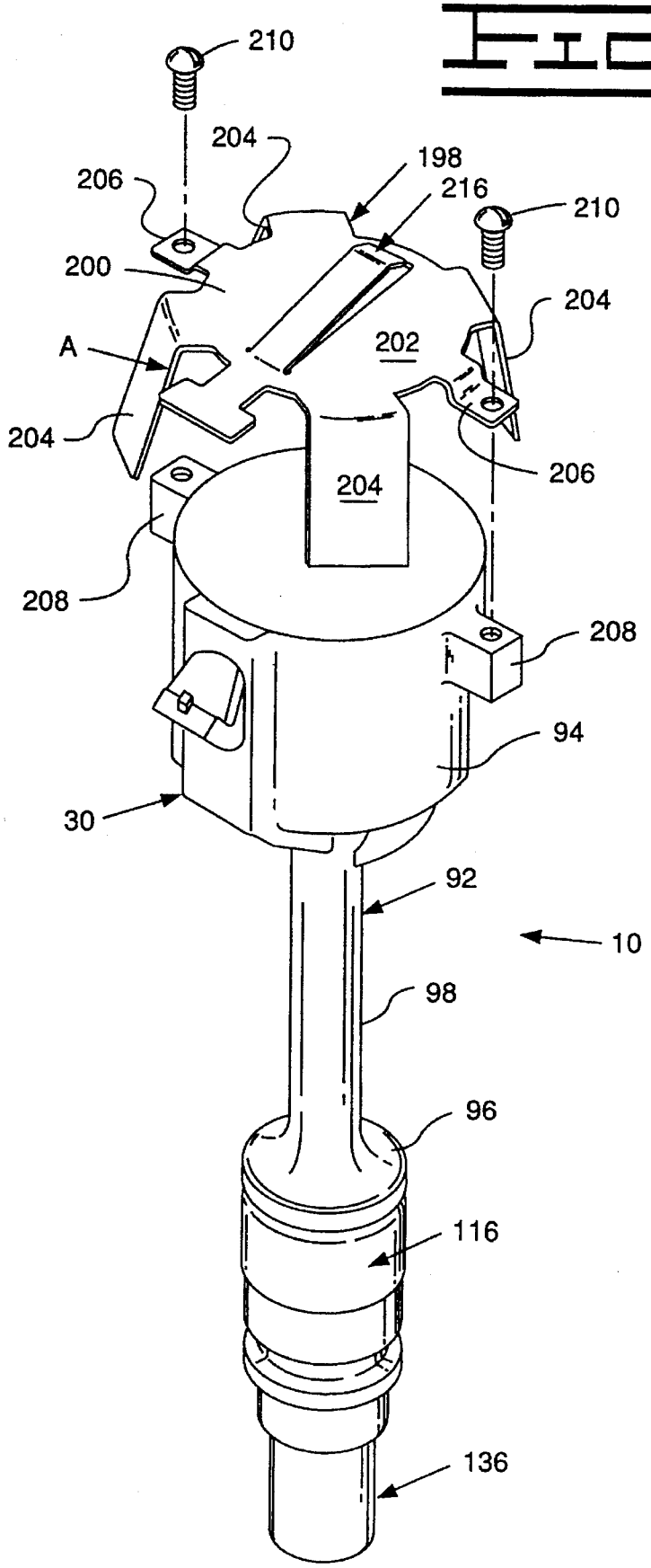
FIG. 3 is an enlarged, diagrammatic, pictorial view of the transformer assembly shown in FIG. 1 with a few parts exploded away from the main body thereof.
Figure 4:
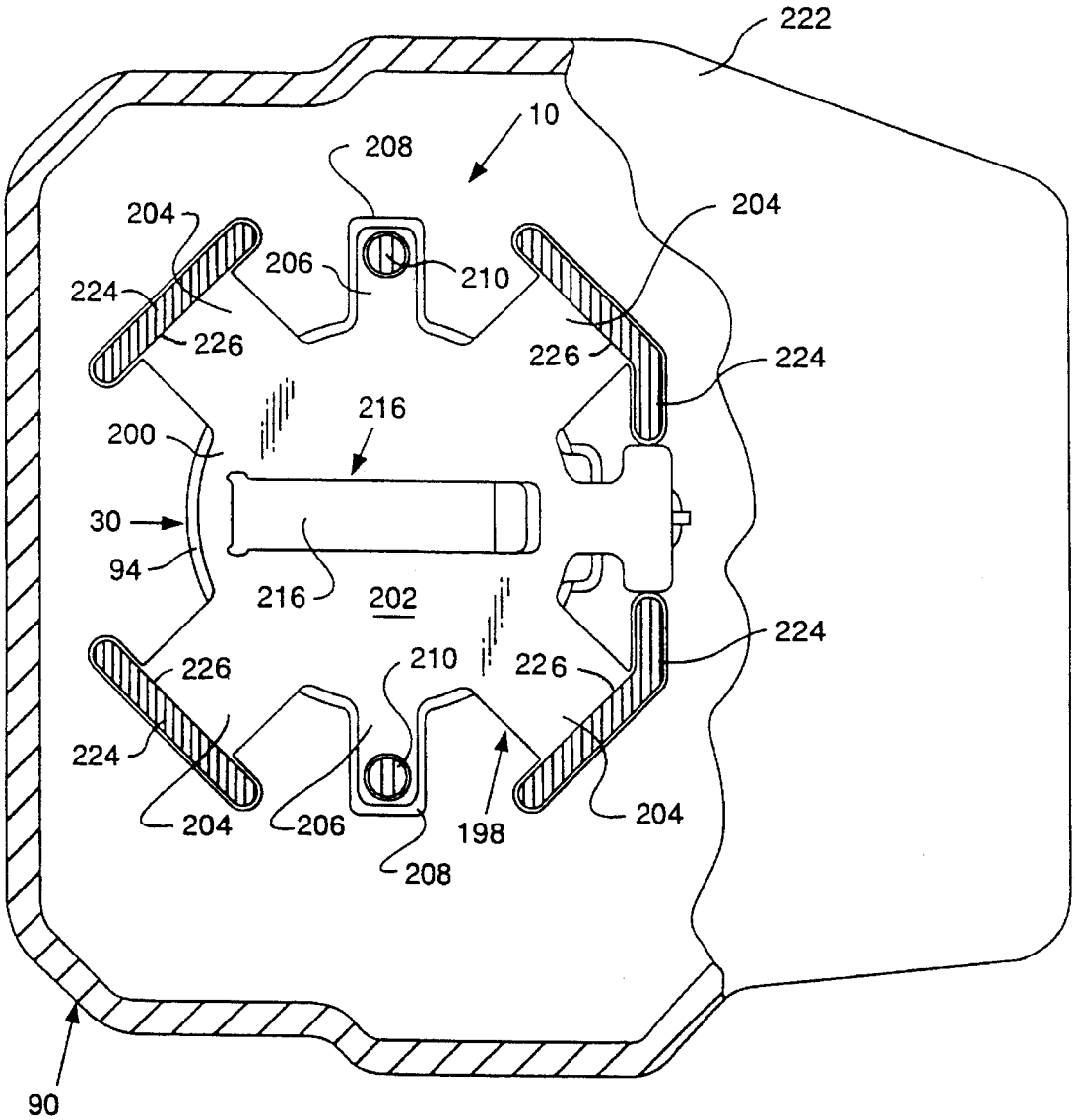
FIG. 4 is a diagrammatic top view of the electrical connector system of FIG. 1 as taken along the lines 4—4, with a portion of the cover broken away to better illustrate the positioning means for securing the transformer assembly and means for axially biasing the electrical conductor in a direction toward the spark plug.

Advantageously, as best shown in FIGS. 1, 3, and 4, positioning means 198 is provided intermediate the cup portion 94 of the transformer assembly 30 and the cover apparatus 90 for resiliently securing the transformer assembly 30 in an aligned relationship with the central axis 20 and for resiliently axially biasing the electrical conductor 184 in a direction toward the volute spring 196 and the spark plug terminal end 16 assuring positive contact. More specifically, the positioning means 198 includes a metal spring member 200 having a generally circular flat body 202 and four deflectable legs 204 extending therefrom. The legs 204 are flat, thin, and flexible, and in the free state are inclined downwardly to individually define a preselected angle A with respect to the flat body 202 as is illustrated in FIG. 3. A pair of aperatured tangs or feet 206 are releasably secured to a corresponding pair of mounting bosses 208 integrally formed on the outside of the cup portion 94. A pair of fasteners or screws 210 can be inserted through the feet 206 and be screwthreadably engaged with the bosses 208 to tightly secure the spring member 200 to the upper cup portion 94 of the transformer assembly 30.

The positioning means 198 includes a second spring 216 connected to the electrical conductor 162 and being moveable between a first position at which the connector is spaced from the second spring and a second position at which the connector is in forcible contact with the second spring. The second spring 216 is an integral leaf spring formed from the flat body 202. The spring 216 is flexible and in the free state are inclined upwardly with respect to the flat body 202 as is illustrated in FIG. 1 and 3.

Referring to FIG. 1, the cover apparatus 90 includes a valve mechanism base 220 releasably secured to the upper surface of the cylinder head 44, and a separate cover 222 releasably and sealingly secured to the base in a conventional manner. The cover 222 has integrally formed therewith four depending guide members 224 shown cross section in FIG. 4. The guide members collectively present slightly downwardly diverging planer surfaces 226.

The spark plug terminal portion 18 is shielded by the electrical conductor second end portion 166 and free from all contact in the installed position of the spark plug 14 in the electrical conductor.

Figure 5:
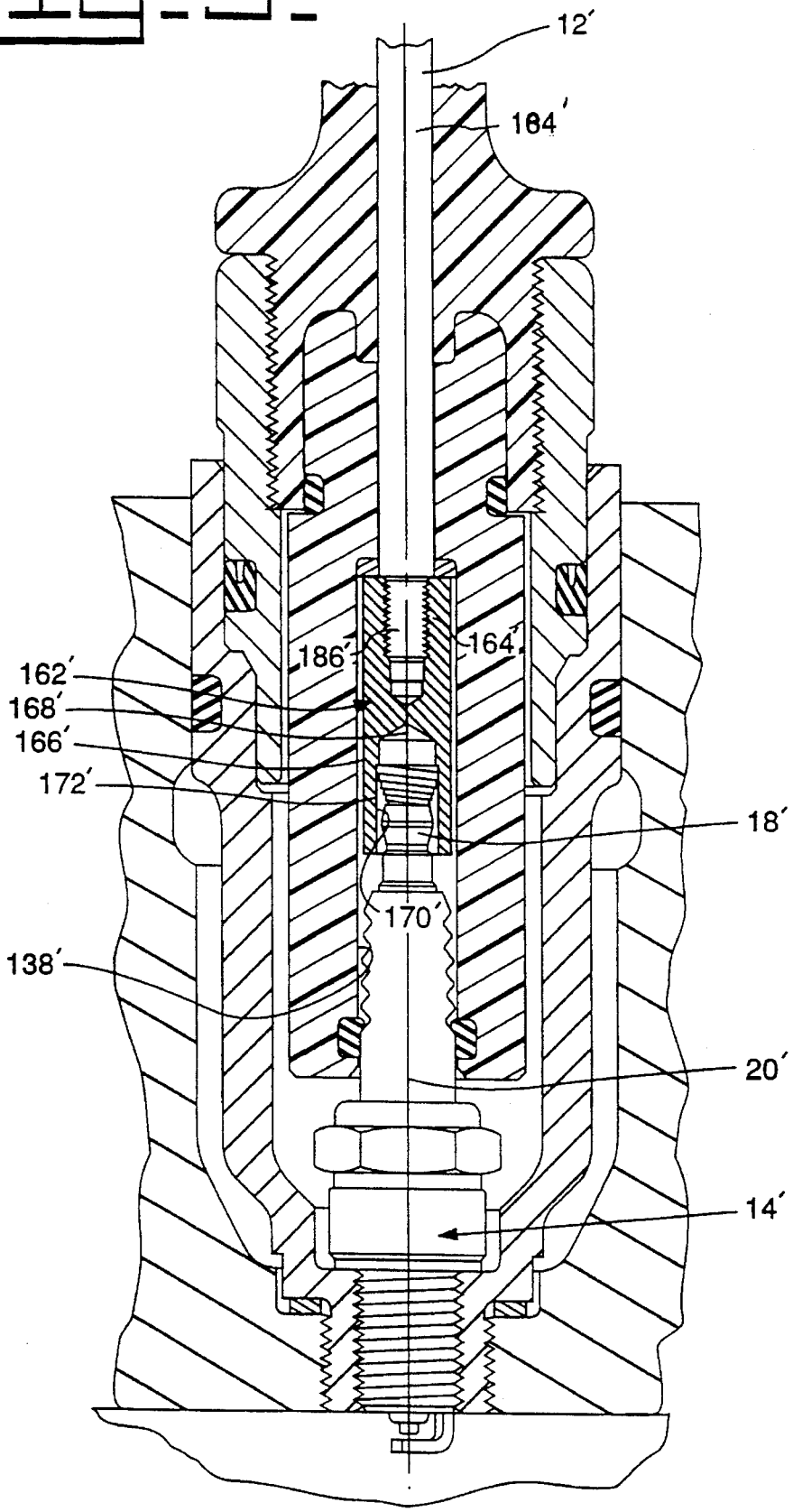
FIG. 5 is an enlarged, diagrammatic view of another embodiment of the electrical connector system with certain portions of the system and the engine shown in cross section to better illustrate details thereof.

Referring now to FIG. 5 of the drawings, another embodiment of the electrical connector system 10 is illustrated. In this embodiment elements that are the same or similar from the previous embodiment are identified by identical numbers followed by a prime (').  As best illustrated in FIG. 5, a generally cylindrical electrical conductor 162' having first and second end portions 164', 166', and an axis 168' coaxial with the axis 20' of the terminal portion 18' is disposed in the shield counterbore 138'. The conductor 162' has an opening 170' extending into the second end portion 166'. The opening 170' has opening sidewalls 172'. Unlike the previous embodiment the second end portion 166' is adapted to receive the spark plug terminal portion 18' therein. The second end portion opening 170' is of a relative size sufficient that the opening sidewalls 172' are free from contact with the spark plug terminal portion 18'.

INDUSTRIAL APPLICABILITY

The transformer assembly 30 including the metal spring member 200 is sealingly installed into the profiled housing bore 56 with the volute spring 196 in electrical contact with the terminal end 16 of the spark plug 14. The opening 170 in the conductor 162 is of a relative size sufficient that the opening sidewalls 170 are free from contact with the spark plug terminal portion 18. This allows for total runout tolerancing of the spark plug terminal portion 18 resulting from a lack of perpendicularity of the spark plug 14 while maintaining electrical continuity to the spark plug electrical conductor 162. The volute spring 196 biases the electrical conductor 162 in a direction away from the spark plug 14 in the installed position.

With the transformer assembly 30 inserted in the bore 56 the cover 222 can be lowered into engagement therewith. The legs 204, which are individually disposed at the initial angle A with respect to the flat body 202 are engaged by the guide members 224 formed within the cover 222 and the pair of springs engage the underside of the cover 222. Further lowering of the cover 222 deflects the legs 204 such that an angle smaller than the angle A is subtended, and results in the legs resiliently loading or holding the upper part of the transformer assembly 30. The spring 216 axially biases the electrical conductor 162 in a direction toward the volute spring 196 and the spark plug terminal end 16. Advantageously, the spring permit axial positioning over a ±3 mm vertical range in this specific instance, providing for tolerance stack-up between the various part without causing an interference which could result in cracking of the spark plug 14 porcelain or a gap which would impede electrical conduction.

The adapter seal ring 128 provides a seal between the outer peripheral surface 118 and the housing bore 56 and also serves as a one-way acting pressure relief seal. The seal 128 is of conventional construction cup or lip type cross-section so as to have directional sealing characteristics with respect to the housing bore 56. The lip portion of the seal ring 128 is preferably pointing upwardly and radially outwardly in an inclined manner to provide automatic relief of any pressure above a predetermined value that may have accumulated in the space around the spark plug 20. Such orientation of the lip portion of the seal ring 128 still prevents oil from penetrating downwardly in the space around the spark plug 20.

The adapter 116 is preferably constructed from a gray iron material. Alternatively the adapter 116 could be constructed from a stainless steel or brass alloy material.

The tubular insulating shield 136 is preferably constructed from an electrical nonconducting ceramic material or alternatively from teflon.

In the alternate embodiment the spark plug terminal portion 18' is shielded by the electrical conductor second end portion 166' and free from all contact in the installed position of the spark plug 14' in the electrical conductor 162'.

Other aspects, objects and advantages of this invention can be obtained from a study of the drawings, the disclosure and the appended claims.

We claim:

1. An electrical connector system for electrically connecting a voltage source to a spark plug having a terminal end and a terminal portion, said spark plug terminal portion having an axis and sidewalls, comprising:

an electrical conductor having first and second ends portions, an axis, an opening extending into the second end portion and said opening having opening sidewalls, said first end portion being adapted to receive a voltage source, said second end portion being adapted to receive the spark plug terminal therein, said second end portion opening being of a relative size sufficient that said opening sidewalls are free from contact with the spark plug terminal portion and said spark plug terminal portion being shielded by said electrical conductor second end portion and free from all contact in the installed position of the spark plug in the electrical conductor;

a spring positioned within the conductor second end portion, said spring being in electrical conducting contact with the conductor and the spark plug terminal end, and biasing the electrical conductor in a direction away from the spark plug in the installed position; and positioning means for axially biasing the electrical conductor in a direction toward the spring and the spark plug terminal end, said positioning means including a second spring.

* * * * *